US006260369B1

(12) United States Patent
Yokomachi et al.

(10) Patent No.: US 6,260,369 B1
(45) Date of Patent: Jul. 17, 2001

(54) FLOW CONTROL VALVE FOR A VARIABLE DISPLACEMENT REFRIGERANT COMPRESSOR

(75) Inventors: Naoya Yokomachi; Kazuo Murakami; Tatsuya Koide; Toshiro Fujii, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/290,972

(22) Filed: Apr. 13, 1999

(30) Foreign Application Priority Data

Apr. 16, 1998 (JP) ..... 10-106717

(51) Int. Cl.[7] ..... F04B 27/08
(52) U.S. Cl. ..... 62/228.5; 62/228.3
(58) Field of Search ..... 62/228.5, 228.3, 62/209, 502

(56) References Cited

U.S. PATENT DOCUMENTS

| | | | | |
|---|---|---|---|---|
| 4,730,986 | | 3/1988 | Kayukawa et al. | 417/222 |
| 4,732,544 | | 3/1988 | Kurosawa et al. | 417/222 |
| 4,864,832 | * | 9/1989 | Suzuki | 62/228.5 X |
| 5,685,160 | | 11/1997 | Abersfelder et al. | 62/114 |
| 5,694,784 | | 12/1997 | Frey et al. | 62/228.5 |

FOREIGN PATENT DOCUMENTS

| | | |
|---|---|---|
| 196 07 032 A1 | 9/1996 | (DE) . |
| 0604417-B1 | 4/1996 | (EP) . |
| 1-142276 | 6/1989 | (JP) . |
| 6-173852 | 6/1994 | (JP) . |
| WO 93.06423 | 4/1993 | (WO) . |

* cited by examiner

*Primary Examiner*—Harry B. Tanner
(74) *Attorney, Agent, or Firm*—Woodcock Washburn Kurtz Mackiewicz & Norris LLP

(57) ABSTRACT

The flow control valve used in a variable displacement refrigerant compressor, which is incorporated in a refrigerating system, and arranged in a controlling passage fluidly interconnecting between a crank chamber and a discharge chamber or a suction chamber to regulate an opening formed in a predetermined portion of the controlling passage in a control characteristics in which when the discharge pressure of the refrigerant discharged from a discharge chamber of the compressor increases, the suction pressure of the refrigerant entering from the refrigerating system into a suction chamber increases. The flow control valve has a pressure sensing member for sensing of one of the suction and the crank-chamber pressure, and a valve element movable to increase and reduce the opening of the predetermined portion of the controlling passage on the basis of sensing of one of the suction and crank-chamber pressures by the pressure-sensing member.

10 Claims, 11 Drawing Sheets

FLOW CONTROL VALVE FOR A VARIABLE DISPLACEMENT REFRIGERANT COMPRESSOR

BACKGROUND OF THE INVENTION

1. Field of the Invention

The present invention relates generally to a flow control valve adapted for being incorporated in a variable displacement refrigerant compressor. More particularly, the present invention relates to a variable displacement refrigerant compressor accommodating therein a flow control valve which permits the compressor to be incorporated in a refrigerating system for a vehicle climate control system.

2. Description of the Related Art

A climate control system for a vehicle incorporates a compressor to compress a refrigerant gas. One typical refrigerant compressor for use in a vehicle climate control system is a conventional variable displacement refrigerant compressor, which is provided with a drive shaft driven for a variable rotation about an axis of rotation thereof by an external drive source, pistons slidably fitted in cylinder bores formed in a cylinder block so as to be reciprocated to suck a refrigerant gas from a suction chamber, to compress the sucked refrigerant gas in the cylinder bores, and to discharge the compressed refrigerant gas from the cylinder bores into a discharge chamber, a variable-inclination cam plate mounted to rotate with the drive shaft within a crank chamber and to be operatively engaged with the pistons to cause the reciprocation of the pistons in response to the rotation thereof while reducing the stroke of reciprocating movement of the pistons in response to an increase in a pressure prevailing in the crank chamber, a controlling passage extending between the discharge chamber and the crank chamber to control the pressure in the crank chamber, and a flow control valve arranged in the controlling passage to control the size of an opening in a portion of the controlling passage.

In the above-described variable displacement refrigerant compressor, when a fluorinated hydrocarbons gas is used as the refrigerant gas, and when the refrigerant compressor is incorporated in a refrigerating system operated under a condition such that a discharge pressure and a suction pressure of the refrigerant gas are always kept below a critical pressure of the refrigerant gas (this type of refrigerating system will be hereinafter referred to as a subcritical-cycle-type refrigerating system), it is possible to adjustably change the displacement of the variable displacement refrigerant compressor by the use of the flow controlling valve as schematically shown in FIG. 14.

Referring to FIG. 14, the conventional flow control valve is constructed so as to be arranged in the controlling passage which extends between the discharge chamber and the crank chamber. The flow control valve is provided with a pressure sensing member 80 moving in response to a detection of a change in a suction pressure Ps, and a valve element 81 connected to the pressure sensing member 80 and movable to adjustably open and close a port 83*a* of the controlling passage 83 in response to the movement of the pressure sensing member 80. The flow control valve receives the suction pressure Ps at the pressure sensing member 80 and moves the valve element 81 in a direction closing the port 83*a* of the controlling passage in response to an increase in the suction pressure Ps. Further, the pressure sensing member 80 of the flow control valve constantly receives a pressing force F of a spring 82 (this pressing force F of the spring is determined by design) to urge the valve element 81, via the pressure sensing member 80, in a direction opening the port 83*a* of the controlling passage 83. The valve element 81 is arranged so as to constantly receive a discharge pressure Pd by which the valve element 81 is urged in a direction to open the portion 83 of the controlling passage.

Thus, the above-mentioned flow control valve acts so that the valve element 81 opens the port 83*a* of the controlling passage 83 when the suction pressure Ps reduces to a pressure below a predetermined set pressure value (it is referred to as a set suction pressure), in order that the refrigerant gas under a discharge pressure Pd flows from the discharge chamber into the crank chamber through the opened port 83*a* of the controlling passage 83. As a result, when a pressure Pc in the crank chamber is increased, the cam plate is moved toward a position which reduces the angle of inclination thereof, so that the stroke of reciprocating movement of the pistons is reduced. As a result, the displacement of the compressor is reduced.

In accordance with the above-described arrangement of the flow control valve, the valve element 81 of the flow control valve constantly receives the discharge pressure Pd urging the valve element 81 in a direction to close the port 83*a* of the controlling passage 83. Therefore, when the spring 82 is set so as to exert a predetermined constant force F, the flow control valve indicates such a control characteristics that the set value of the suction pressure Ps acting on the pressure sensing member 80 may be reduced as the discharge pressure Pd acting on the valve element 81 increases. Namely, the relationship between the discharge pressure Pd and the suction pressure Ps which act in the flow control valve indicates a characteristic curve represented by a straight line sloping down from the left to the right in a rectangular coordinates, as shown in FIG. 15. Thus, when the discharge pressure Pd acting on the valve element 81 increases, the set value of the suction pressure Ps acting on the pressure sensing member 80 decreases.

When an actual pressure level of the suction pressure Ps prevailing in the suction pressure region in the refrigerant compressor reduces to a value in an area below the line in FIG. 15, the valve element 81 of the flow control valve is moved to a position opening the port 83*a* permitting the refrigerant gas under the discharge pressure Pd to enter the crank chamber, and accordingly, when the pressure Pc in the crank chamber is increased, the cam plate is moved to reduce the displacement of the compressor.

Nevertheless, when a refrigerant compressor incorporating therein the above-described flow control valve is operated under a high rotating speed, and when an amount of the refrigerant circulating through a refrigerating system is increased until an excessive increase in the refrigerating performance of the refrigerating system occurs, it is very difficult to quickly reduce the refrigerating performance of the refrigerating system by adjustably controlling the displacement of the refrigerant compressor. This difficulty in controlling the displacement of the compressor is specifically encountered by a refrigerating system of the type in which a closed refrigerant-circulation path of the refrigerating system includes a high-pressure path in which the refrigerant is under a high discharge pressure and, more specifically, is under a supercritical pressure. This type of refrigerating system will be hereinafter referred to as a supercritical-cycle-refrigerating system and, in this system, when the rotating speed of the refrigerant compressor accommodated in the system is increased, the pressure (the discharge pressure) in the high-pressure path can be quickly increased. However, in a low-pressure path of the refrigerant-circulating path, an evaporating pressure (a suction pressure) of the refrigerant cannot be quickly reduced. Thus, when the flow control valve incorporated in the refrigerant compressor has the aforementioned operating characteristics having a straight line relationship between Pd and Ps, and when the rotating speed of the compressor is increased to increase the discharge pressure Pd, the set pressure value of the suction pressure Ps acting on the pressure sensing member 80 of the flow control valve is accordingly reduced to make it difficult to quickly move the valve element 81 in a direction opening the port 83*a* of the controlling passage 83. Namely, the control of the displacement of the refrigerant compressor is delayed.

EP-0604417B1, based on PCT/N091/00119 (the corresponding published Japanese Translation No. 6-510111), discloses a typical supercritical cycle type refrigerating system including a refrigerant compressor, a heat-radiating type heat exchanger (a gas cooler), a throttling means, a heat-absorbing type heat exchanger (an evaporator), and a liquid-gas separator (an accumulator) which are connected in series to form a closed refrigerant-path. In the disclosed refrigerating system, a temperature at outlet of the gas cooler arranged in the high-pressure path is detected by a temperature sensor, and the operation of the throttling means disposed downstream of the gas cooler in the high-pressure path is controlled on the basis of the detected temperature of the gas cooler outlet to thereby adjust the pressure level prevailing in the high pressure path so that an energy consumption in the refrigerating system is suppressed.

In order to suppress the energy consumption in the supercritical-cycle-type refrigerating system to the minimum, the compressor should be operated under a condition such that a coefficient of performance (COP=Q/W) defined as a ratio of a refrigerating performance (Q) of the evaporator against a compressing work (W) externally applied to the refrigerant compressor becomes the possible maximum value.

It will be understood that the larger a change in the refrigerating performance (Q) of the evaporator is, that is to say, the larger a change in an enthalpy (a difference between an enthalpy at the outlet and that at the inlet of the evaporator) which occurs during the flowing of the refrigerant through the inside of the evaporator is, and the smaller the compressing work (W) necessary for compressing the refrigerant in the refrigerant compressor is, the larger is above-mentioned coefficient of performance (COP) of the refrigerating system. Thus, in the supercritical-cycle-type refrigerating system, when the temperature of the refrigerant detected at the outlet of the heat-radiating type heat exchanger (the gas cooler) in the high-pressure path is kept substantially constant, the coefficient of performance (COP) of the refrigerating system can be increased by increasing a pressure in the high-pressure path to thereby increase the refrigerating performance (Q). This capability of increasing the coefficient of performance (COP) of the supercritical-cycle-type refrigerating system is a remarkable characteristics that could not be exhibited by the subcritical-cycle-type refrigerating system, and accordingly, the operation of the throttling means in the supercritical-cycle-type refrigerating system is different from that of the throttling means included in the subcritical-cycle-type refrigerating system. More specifically, when referring to FIG. 16, which shows a diagram indicating a relationship between a pressure and an enthalpy (a Pressure-enthalpy (P-H) diagram or a Mollier diagram) of a supercritical-cycle-type refrigerating system employing carbon dioxide ($CO_2$) gas as a refrigerant, it can be seen that the refrigerating performance (Q) of the evaporator is increased in response to an increase in a differential ($\Delta H_1=H_A-H_D$) between an enthalpy ($H_D$) at the inlet (the point D) and that ($H_A$) at the outlet (the point A) of the evaporator, and in response to an increase in an amount of mass flow of the refrigerant flowing through the evaporator. At this stage, when an excessive heating at the outlet (A) of the evaporator increases to an unusually great extent, the specific volume of the refrigerant sucked into the refrigerant compressor increases and the volumetric efficiency of the compressor is reduced in response to an increase in the temperature of the discharged refrigerant, and as a result, an amount of circulation of the refrigerant, i.e., an amount of refrigerant supplied to the evaporator as per a unit time (Kg/h) is reduced to result in an reduction in the refrigerating performance (Q) of the evaporator. Therefore, in order to avoid such a reduction in the refrigerating performance, which is caused by the reduction in the amount of circulation of the refrigerant, by maintaining the extent of the excessive heating at the outlet of the evaporator substantially constant, it is necessary to maintain the enthalpy ($H_A$) at the outlet (the point A) of the evaporator substantially constant.

On the other hand, the enthalpy ($H_D$) of the inlet (the point D) of the evaporator is equal to the enthalpy ($H_C$) at the outlet (the point C) of the gas cooler due to the fact that an expanding process in the throttle means is conducted as an isoenthalpy change. Therefore, the differential ($\Delta H_1=H_A-H_D$) between the enthalpy ($H_D$) at the inlet (the point D) and that ($H_A$) at the outlet (the point A) of the evaporator, and in turn the refrigerating performance (Q) of the evaporator can be increased by reducing the enthalpy ($H_C$) at the outlet (the point C) of the gas cooler. The interior of the gas cooler in the high-pressure path in which the refrigerant under an supercritical pressure flows, is kept as a single vapor phase occupied by only a high pressure vapor, a pressure in the high-pressure path can be adjusted irrespective of the temperature of the refrigerant at the outlet (point C) of the gas cooler. When the temperature of the refrigerant at the outlet (the point C) of the gas cooler is kept substantially constant, for example, at 40° C., it will be understood from the isothermal line at 40° C. of the P-H diagram of FIG. 16 that higher the pressure in the high-pressure path is, smaller the enthalpy ($H_C$) at the outlet (the point C) of the gas cooler is. Accordingly, when the temperature of the refrigerant at the outlet (the point C) of the gas cooler is maintained substantially constant, the above-mentioned refrigerating performance (Q ($=\Delta H_1$)), and in turn the coefficient of performance (COP) can be increased by increasing the pressure in the high-pressure path to thereby reduce the enthalpy ($H_C$) at the outlet (the point C) of the gas cooler. It should be noted that the temperature of the refrigerant at the outlet (the point C) of the gas cooler is substantially equal to the temperature of the air conducting a heat exchange with the refrigerant in the gas cooler.

On the other hand, when the temperature of the refrigerant at the outlet (the point C) of the gas cooler is maintained substantially constant, e.g., at 40° C., and when the pressure in the high-pressure path is increased, the compressing work ($W=\Delta H_2=H_B-H_A$) to be done by the refrigerant compressor increases.

In this case, since the compression of the refrigerant performed by the compressor is considered to be an adiabatic compression, the compressing operation is processed as an isoenthalpy change, and the compressing work (W) is considered to be equal to a differential between the enthalpy ($H_A$) at the suction inlet (the point A) of the compressor and the enthalpy ($H_B$) at the delivery outlet (the point B) of the compressor. Therefore, when the pressure in the high-pressure path is excessively increased, an increase in the compressing work (W) performed by the compressor occurs causing a reduction in the coefficient of performance (COP) of the refrigerating system.

Thus, when the temperature of the refrigerant detected at the outlet (the point C) of the gas cooler is a given temperature, there correspondingly exists a pressure in the high-pressure path which can be determined by the relationship between the refrigerating performance (Q) and the compressing work (W) to be optimum for obtaining the maximum value of the above-mentioned. Therefore, with respect to various temperatures of the refrigerant at the outlet (the point C) of the gas cooler, there are corresponding pressures in the high-pressure path, and accordingly, when the respective pressures are plotted on the P-H diagram, it is possible to obtain an optimum line of control as shown in FIG. 16.

In the supercritical-cycle-type refrigerating system disclosed in EP-0604417B1, the temperature and the pressure of the refrigerant at the outlet (the point C) of the gas cooler are detected by respective sensors, and on the basis of the aforementioned optimum line of control, determination of an optimum pressure in the high-pressure path is carried out with respect to the detected temperature of the refrigerant. Then, the throttle means is controlled so as to adjustably change an actual pressure in the high-pressure path to the determined optimum pressure, and accordingly, the coefficient of performance (COP) of the refrigerating system is increased to the maximum while the energy consumption in the refrigerating system is reduced to the minimum.

In the case of a vehicle refrigerating system, a refrigerant compressor incorporated in the system is driven by a vehicle engine. Therefore, when the speed of rotation of the vehicle engine increases, the drive power applied from the vehicle engine to the compressor is in turn increased. Therefore, an amount of circulation of the refrigerant (Kg/h) flowing through the evaporator is increased, and the refrigerating performance (Q) often becomes excessive. Therefore, in order to prevent the excessive refrigerating performance of the refrigerating system when the number of rotation of the vehicle engine increases, it is necessary to reduce the path of the throttling means, so that the above-mentioned amount of circulation of the refrigerant is reduced. However, when the path of the throttling means is simply reduced, the pressure in the evaporator is reduced to cause a reduction in the temperature of the refrigerant to a saturation temperature corresponding to the reduced pressure, and the required prevention of the excessive refrigeration cannot be achieved. Therefore, when the speed of rotation of the vehicle engine is increased, the size of opening of the throttling means is reduced while simultaneously the displacement of the compressor is correspondingly reduced. Namely, a variable displacement refrigerant compressor which can change its displacement on the basis of detection of a suction pressure (a pressure of the refrigerant at the outlet of the evaporator) and a temperature of the refrigerant at the outlet of the evaporator, is employed so as to reduce the displacement of the compressor, in response to an increase in the number of rotation of the vehicle engine. Thus, the amount of circulation of the refrigerant is reduced in response to the reduction in the displacement of the compressor, and also the temperature of the refrigerant in the evaporator due to an increase in the suction pressure, i.e., an increase in the pressure of the refrigerant in the evaporator caused by the reduction in the displacement of the compressor can be obtained. Consequently, excessive refrigeration due to an increase in the speed of rotation of the vehicle engine can be effectively prevented.

Nevertheless, in the above-described supercritical-cycle-type refrigerating system, when the flow control valve described with reference to FIGS. 14 and 15 is incorporated in a variable displacement compressor to adjustably change the displacement thereof, there occurs a problem such that the control of the displacement of the compressor in response to a change in an increase in the speed of rotation of the vehicle engine cannot be quickly achieved during the supercritical refrigerating cycle. Namely, in the supercritical refrigerating system, the temperature and the pressure of the refrigerant at the outlet (the point C) of the gas cooler in the high-pressure path are detected, and the throttling means is regulated so that the pressure of the refrigerant at the outlet (the point C) of the gas cooler is varied to an optimum pressure corresponding to the detected temperature, and as a result, the maximum coefficient of performance (COP) and in turn, the minimum energy consumption of the supercritical refrigerating system are achieved. In the supercritical refrigerating system for a vehicle, which requires a regulating operation of the throttling means, when an increase in the speed of rotation of the vehicle engine and in turn the rotating speed of the drive shaft of the refrigerant compressor (the variable displacement compressor) occur, a mass amount of the refrigerant supplied to the gas cooler is increased. Thus, a pressure of the refrigerant in the gas cooler (i.e., a pressure in the high-pressure path and a discharge pressure of the compressor) is increased. Further, as described hereinabove, since the throttling means is regulated so that the pressure at the outlet of the gas cooler is kept substantially constant, the path of the throttling means must be increased to prevent an increase in the pressure at the outlet of the gas cooler. Therefore, the operation of the throttling means to reduce the path thereof is often slow to result in that the control of the refrigerating performance cannot be quickly achieved.

As will be understood, in accordance with an operating characteristics of the supercritical-cycle-type refrigerating system, when the number of rotation of the drive shaft of a compressor incorporated in the system is increased, a pressure in the high-pressure path of the refrigerating system, i.e., a discharge pressure of the refrigerant delivered by the compressor can be quickly increased, but a pressure in the low-pressure path, i.e., a suction pressure to be sucked into the compressor cannot be quickly reduced. Therefore, when the flow control valve as described in connection with FIGS. 14 and 15 is incorporated in the compressor, the set value of the suction pressure (Ps) acting on the pressure sensing member of the valve is reduced by an increase in the pressure prevailing in the high-pressure path, and accordingly, an occurrence of an excessive refrigeration of the system cannot be successfully prevented.

SUMMARY OF THE INVENTION

An object of the present invention is to obviate the above-described problems encountered by the conventional supercritical refrigerating system incorporating therein a variable displacement refrigerant compressor having the described conventional flow control valve.

Another object of the present invention is to provide a flow control valve incorporated in a refrigerant compressor for a refrigerating system, e.g., a vehicle refrigerating system, and capable of exhibiting an operating characteristic in which, when the speed of rotation of a drive shaft of the compressor is increased, the refrigerating performance of the refrigerating system can be quickly adjusted, and accordingly, an occurrence of excessive refrigeration in the refrigerating system due to an increase in the speed of rotation of the drive shaft of the compressor can be surely prevented.

A further object of the present invention is to provide a refrigerant compressor suitable for being incorporated in a refrigerating system and, particularly, in a vehicle refrigerating system provided with the flow control valve capable of exhibiting the operating characteristics described in connection with the above second object.

In accordance with the present invention, there is provided a flow control valve for use with a variable displacement refrigerant compressor having a drive shaft rotationally driven by a drive source, a cylinder block provided with a cylinder bore allowing a piston to reciprocate therein to thereby compress a refrigerant sucked from a suction chamber and discharge the refrigerant after compression into a discharge chamber, a variable inclination cam plate arranged in a crank chamber to reciprocate the piston on the basis of the rotation of the drive shaft and to change a reciprocating stroke of the piston in response to a adjustable change in a crank chamber pressure prevailing in the crank chamber, and a controlling passage fluidly connecting the crank chamber to one of the discharge and suction chambers, wherein the flow control valve comprises:

a pressure sensing member arranged to perform a movement in response to the sensing of at least one of a suction pressure and a crank chamber pressure;

a valve element operatively engaged with the pressure sensing member and to adjustably change an opening formed in a predetermined portion of the controlling passage in response to the movement of the pressure sensing member caused by the sensing of at least one of the suction and crank chamber pressures; and means for forming an arrangement wherein the pressure sensing member and the valve element have a flow controlling characteristic such that the suction pressure acting on the pressure sensing member increases in compliance with an increase in a discharge pressure prevailing in the discharge chamber.

In order to show the flow controlling characteristics of the described flow control valve, when a relationship between a high pressure, i.e., the discharge pressure and a low pressure, i.e., the suction pressure is shown in a rectangular coordinate system having an abscissa to indicate the high pressure and an ordinate to indicate the low pressure, it can be represented by a straight line sloping up from the left to the right in a first quadrant of the coordinate system. More specifically, the flow control valve is provided with such a control characteristics that when the suction pressure is used as the set pressure of the pressure sensing member to variably control the displacement of the refrigerant compressor, in other words, when a control is made so as to reduce the displacement of the refrigerant compressor in response to a reduction in the suction pressure of the compressor below the set pressure of the sensing member, the set pressure of the pressure is gradually increased according to an increase in the discharge pressure.

Therefore, when the speed of rotation of a vehicle engine is increased to increase the rotating speed of the drive shaft of the compressor, the discharge pressure of the refrigerant in the compressor is quickly increased, and even when the reduction in the evaporating pressure in the low-pressure path of a refrigerating system is delayed, the above-mentioned control characteristics of the flow control valve, which increases the set pressure of the pressure sensing member in response to an increase in the discharge pressure, will enable it to quickly reduce the suction pressure below the set pressure. Thus, it is possible to reduce the refrigerating performance of the refrigerating system by quickly reducing the displacement of the compressor. Accordingly, any excessive refrigeration due to an increase in the number of rotation of the vehicle engine, i.e., an increase in the rotating speed of the drive shaft of the compressor can be surely prevented.

Preferably, the valve element of the flow control valve is arranged in the controlling passage which fluidly interconnects between the crank chamber and the discharge chamber of the variable displacement refrigerant compressor, and the discharge pressure is applied to the valve element to urge the movement thereof in a direction increasing the opening of the predetermined portion of the controlling passage.

In the described flow control valve, the discharge pressure acting on the valve element constantly acts so as to increase the opening of the predetermined portion of the controlling passage. Thus, when an increase in the discharge pressure occurs, the increased discharge pressure permits the valve element to easily move in the direction increasing the opening of the controlling passage. Then, the refrigerant under the discharge pressure is supplied from the discharge chamber into the crank chamber of the compressor to thereby increase the crank chamber pressure Pc. Therefore, a back pressure acting on the cam plate is increased to reduce an angle of inclination of the cam plate. Accordingly, the reciprocating stroke of the piston is decreased so as to reduce the amount of the compressed refrigerant discharged from the cylinder bore. Namely, the displacement of the compressor is reduced. The reduction in the displacement of the compressor causes an increase in the suction pressure of the compressor.

Preferably, the pressure sensing member of the flow control valve is arranged to move in response to the sensing of a change in one of the suction and crank chamber pressures with respect to a set pressure, and the set pressure may be changed by a solenoid means as required.

When the variable displacement refrigerant compressor is accommodated in a vehicle refrigerating system in which the compressor, a radiation type heat exchanger, a throttling means, and a absorption type heat exchanger are connected in series, since the set pressure of the suction pressure acting on the sensing element of the flow control valve can be changed by the solenoid means, it is possible to change a temperature of the air blowing out of the absorption type heat exchanger by changing the set pressure of the flow control valve. For example, when the pressure sensing member is arranged to receive and sense a suction pressure and to move in response to the sensing of the suction pressure with respect to a set pressure to adjustably change the displacement of the compressor, and when the set pressure of the pressure sensing member is increased by the solenoid means, a suction pressure received and sensed by the pressure sensing member as being higher than the increased set pressure is higher than a suction pressure that is sensed as larger than the set pressure before being increased by the solenoid means. Under the condition of the increased set pressure, the displacement of the compressor is reduced when the higher suction pressure sensed by the pressure sensing member goes below the increased set pressure. Therefore, the temperature of the air blowing out of the absorption type heat exchanger is increased.

On the other hand, when the set pressure of the pressure sensing member is reduced by the solenoid means, a suction pressure received and sensed by the pressure sensing member as being lower than the reduced set pressure is lower than a suction pressure that sensed as being lower than the set pressure before being reduced by the solenoid means. Therefore, the displacement of the compressor cannot be reduced until the suction pressure goes below the reduced set pressure. As a result, the temperature of the air blowing out of the absorption type heat exchanger is reduced. Accordingly, when the set pressure of the pressure sensing member is adjustably changed by the solenoid means, fine adjustment of the climate control can be achieved by the vehicle refrigerating system.

Further preferably, the variable displacement compressor in which the flow control valve is incorporated to control the displacement thereof, is a compressor of the type wherein the delivery of the refrigerant is conducted under a supercritical pressure of the refrigerant.

When the variable displacement refrigerant compressor delivers therefrom the refrigerant under the supercritical pressure into a refrigerating system, the refrigerating system is constructed as a supercritical-cycle-type refrigerating system. In this case, an increase in the speed of rotation of the drive shaft of the compressor causes a time delay in reducing the suction pressure of the refrigerant, so that an excessive refrigeration may occur in the supercritical-cycle-type refrigerating system. Nevertheless, when the flow control valve is provided with a control characteristics in which the suction pressure increases in response to an increase in the discharge pressure, the amount of displacement of the compressor can be quickly reduced to quickly reduce the refrigerating performance of the supercritical-cycle-type refrigerating system. As a result, an occurrence of excessive refrigeration due to an increase in the speed of rotation of the drive shaft of the compressor can be successfully prevented.

In the described flow control valve, which is used with the refrigerant compressor, the refrigerant compressed by the compressor is a carbon dioxide gas.

In accordance with another aspect of the present invention, there is provided a variable displacement refrigerant compressor comprising:

a drive shaft rotationally driven by a drive source;

a cylinder block provided with a cylinder bore allowing a piston to reciprocate therein to thereby compress a refrigerant sucked from a suction chamber and discharge the refrigerant after compression into a discharge chamber;

a variable inclination cam plate arranged in a crank chamber to reciprocate the piston on the basis of the rotation of the drive shaft and to change a reciprocating stroke of the piston in response to an adjustable change in a crank chamber pressure prevailing in the crank chamber;

a controlling passage fluidly connecting the crank chamber to one of the discharge and suction chambers; and a flow control valve arranged in the controlling passage to regulate a flow of the refrigerant which passes through a predetermined portion of the controlling passage, wherein the flow control valve comprises:

a pressure sensing member arranged to perform a movement in response to the sensing of at least one of a suction pressure and a crank chamber pressure;

a valve element operatively engaged with the pressure sensing member and to adjustably change an opening formed in the predetermined portion of the controlling passage in response to the movement of the pressure sensing member caused by the sensing of at least one of the suction and crank chamber pressures; and means for forming an arrangement in which the pressure sensing member and the valve element have a flow controlling characteristics in which the suction pressure acting on the pressure sensing member increases in compliance with an increase in a discharge pressure prevailing in the discharge chamber.

The refrigerant compressor provided with the above-described flow control valve can operate in such manner that when the speed of rotation of the drive shaft is increased, the displacement of the compressor may be quickly reduced to reduce the refrigerating performance of a refrigerating system in which the refrigerant compressor is incorporated. Thus, the excessive refrigeration which might occur in response to an increase in the number of rotation of the drive shaft can be surely prevented.

The above-described variable displacement refrigerant compressor compresses the refrigerant in the gas phase and discharges the compressed refrigerant under its supercritical pressure condition. Preferably, the refrigerant used with the above-described refrigerant compressor is carbon dioxide.

BRIEF DESCRIPTION OF THE DRAWINGS

The above and other objects, features, and advantages of the present invention will be made more apparent from the ensuing description of the preferred embodiments, with reference to the accompanying drawings wherein.

DESCRIPTION OF THE PREFERRED EMBODIMENTS (The First Embodiment)

Figure 1:
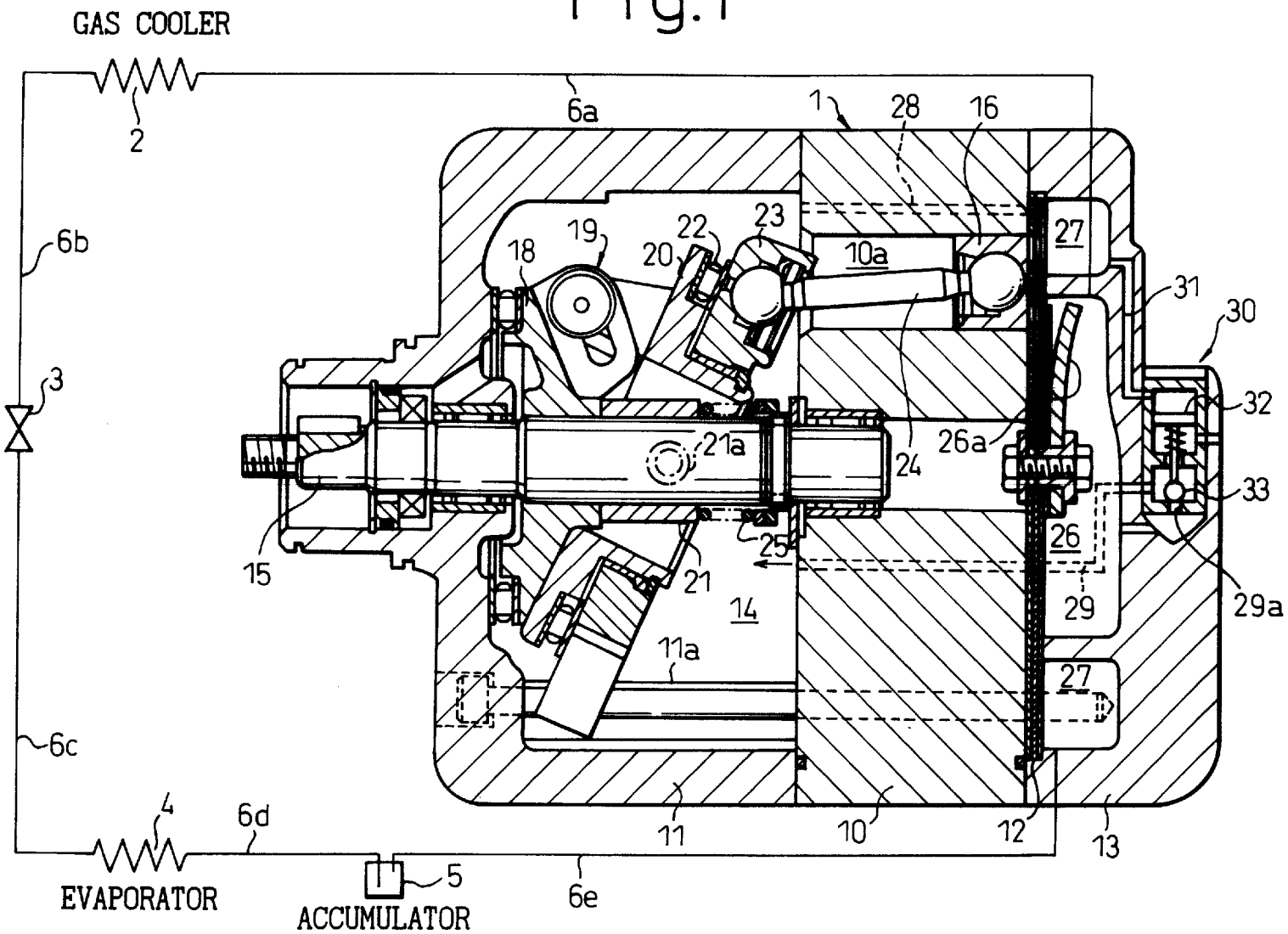
FIG. 1 is a longitudinal cross-sectional view of a variable displacement refrigerant compressor provided with a flow control valve according to a first embodiment of the present invention, and a schematic diagram of a vehicle refrigerating system in which the refrigerant compressor is incorporated to compress a refrigerant.

Referring to FIG. 1, a vehicle refrigerating system conducting a supercritical refrigerating cycle includes a refrigerant compressor 1, especially a variable displacement refrigerant compressor. The refrigerating system further includes a gas cooler 2 functioning as a radiation type heat exchanger, an expansion valve 3 functioning as a throttling means, an evaporator 4 functioning as a heat-absorption-type heat exchanger, and an accumulator 5 functioning as a gas-liquid separator. The compressor 1 and the above-mentioned other devices 2 through 5 are connected in series via a closed fluid passage. Namely, a discharge chamber 26 of the compressor 1 is connected to the gas cooler 2 via a fluid passage 6*a* made of an appropriate conduit member. The gas cooler 2 is in turn connected to the expansion valve 3 via a fluid passage 6*b*. The expansion valve 3 is further connected to the evaporator 4 via a fluid passage 6*c*. The evaporator 4 is connected to the accumulator 5 via a fluid passage 6*d*, and the accumulator 5 is connected to a suction chamber 27 via a fluid passage 6*e* to form the closed refrigerant passage through which the refrigerant circulates.

In the vehicle refrigerating system of FIG. 1, the refrigerant under a high pressure (a discharge pressure) flows through a high-pressure passage side of the system, including the fluid passages 6*a*, 6*b*, and 6*c*, and the refrigerant under a low pressure flows through a low-pressure passage side of the system, including the fluid passages 6*d* and 6*e*. Further, the refrigerating system operates so that the high pressure in the high-pressure passage side is maintained at a supercritical pressure condition. The refrigerant employed for the described vehicle refrigerating system is preferably a carbon dioxide ($CO_2$). The refrigerant may alternately be one of ethylene ($C_2H_4$), Diborane ($B_2H_6$), ethane ($CH_3CH_3$), and nitrogen oxide.

Figure 16:
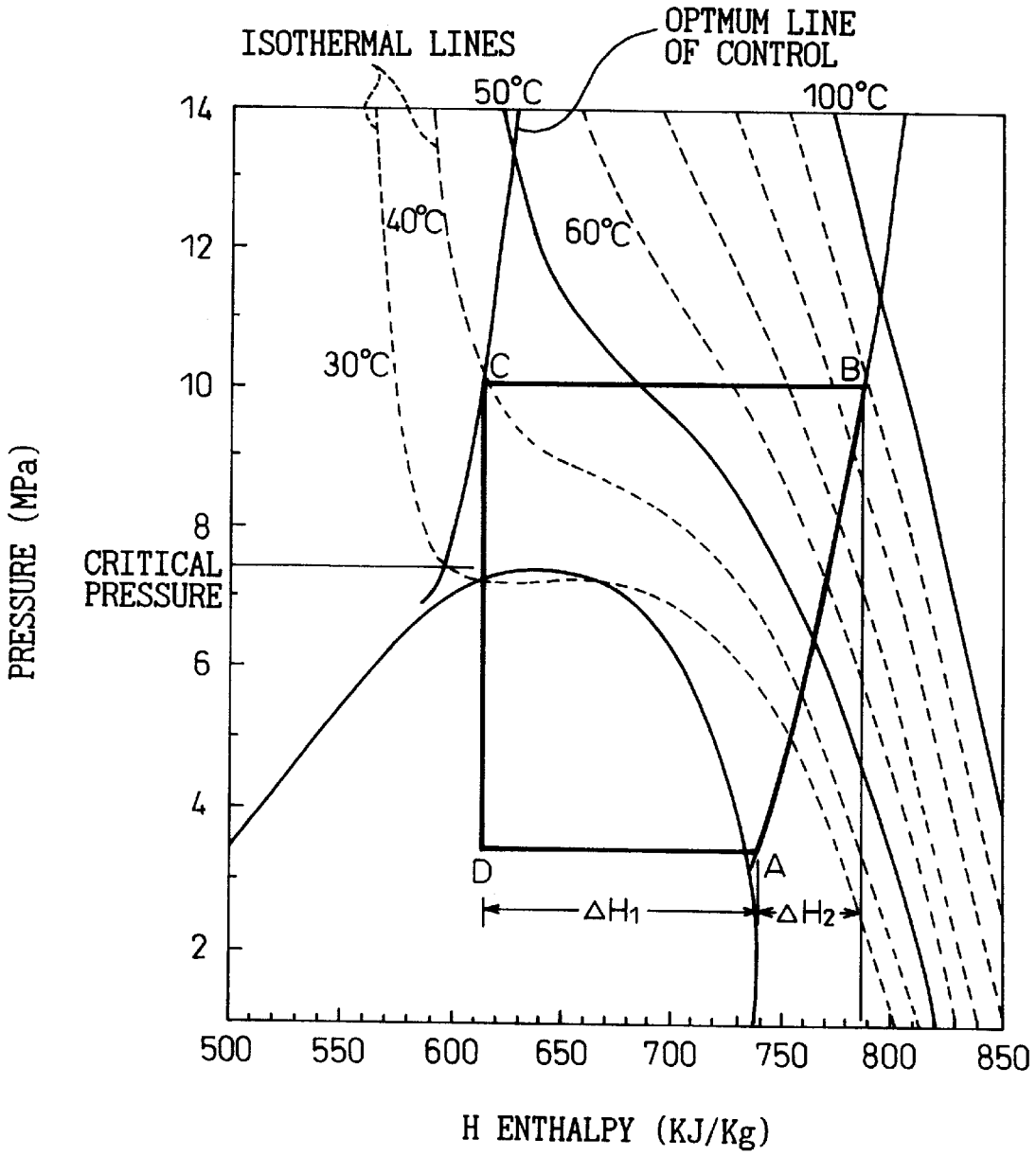
FIG. 16 is a diagrammatic view indicating a pressure-enthalpy diagram in a super-critical-cycle refrigerating system, which employs a carbon dioxide as a refrigerant.

The expansion valve 3 is provided so that its valve opening is regulated and adjusted based on the temperature and the pressure of the refrigerant detected at the outlet of the gas cooler 2, and the regulation of the valve opening of the expansion valve 3 is performed in such a manner that the temperature and pressure of the refrigerant detected at the outlet of the gas cooler 2 have a relationship corresponding to that indicated by the aforementioned optimum line of control (FIG. 16), and accordingly, the aforementioned coefficient of performance (COP) of the refrigerating system becomes the maximum.

The refrigerant compressor 1 is a variable displacement refrigerant compressor provided with a flow control valve 30 according to a first embodiment of the present invention, which can function as a displacement control valve to control the displacement (or an amount of delivery of the refrigerant after compression from the discharge chamber 26) of the refrigerant compressor 1. It should be understood that the compressor 1 of FIG. 1 may incorporate therein one of the later-described various flow control valves 30 instead of the described valve 30 of the first embodiment.

Referring again to FIG. 1, when a pressure prevailing in the crank chamber 14 is increased, the displacement of the compressor 1 is reduced, and a pressure in the crank chamber 14 is increased due to an increase in the discharge pressure of the compressor 1.

The refrigerant compressor 1 includes a cylinder block 10 having front and rear ends thereof. A front housing 11 is sealingly connected to the front end of the cylinder block 10, and a rear housing 13 is sealingly connected to the rear end of the cylinder block 10 via a valve plate 12. The front housing 11 and the cylinder block 10 define the above-mentioned crank chamber 14 in front of the front end of the cylinder block 10. An axial drive shaft 15 is supported by the cylinder block 10 and the front housing 11 via a pair of axially spaced radial bearings and a shaft seal device to be rotatable within the crank chamber 14. A front end of the drive shaft 15 extends beyond the frontmost end of the front housing 11 and is connected to an armature of a solenoid clutch (not shown in FIG. 1). A thrust bearing (not shown) and a disc-spring (not shown) are arranged between the valve plate 12 and the rear end of the axial drive shaft 15. The cylinder block 10 is provided with a plurality of cylinder bores 10*a* arranged around the axis of rotation of the drive shaft 15, and a plurality of pistons 16 are slidably fitted in the respective cylinder bores 10*a* to perform a reciprocating motion therein.

A rotor element 18 is mounted on the drive shaft 15 within the crank chamber 14 and is axially supported by an inner wall of the front housing 11 via a thrust bearing. Thus, the rotor element 18 rotates together with the drive shaft 15. The rotor element 18 is connected to a rotable cam plate 20 via a hinge mechanism 19 so as to rotate the cam plate 20.

A sleeve element 21 is slidably mounted on a portion of the drive shaft 15 within the crank chamber 14, and the sleeve element 21 is provided with pivots 21*a* about which the cam plate 20 is pivotally mounted. A wobble plate 23 is non-rotatably mounted on the cam plate 20 via a thrust bearing 22 and other bearing means. The wobble plate 23 is provided with a rotation-preventing pin (not shown) fixedly connected thereto to be slid in an axial groove 11*a* formed in the front housing 11, so that the wobble plate 23 is prevented from rotating the rotation of the cam plate 20 and the drive shaft 15. The wobble plate 23 is operatively connected to the respective pistons 16 via piston rods 24, so that the wobbling motion of the wobble plate 23 driven by the rotation of the cam plate 20 causes the reciprocation of the pistons 16. The reciprocating stroke of the respective pistons 16 depends on an angle of inclination of the wobble plate 23 with respect to a plane perpendicular to the axis of rotation of the drive shaft 15.

A spring member 25 is arranged between the sleeve 21 and a clip element mounted on the drive shaft 15 at a position adjacent to the front end of the cylinder block 10, so that the cam plate 20 is constantly urged toward the rotor element 18. Thus, the inclination of the cam plate 20 and the wobble plate 23 is set at a maximum angle position before the start of the operation of the compressor 1. When the cam plate 20 and the wobble plate 23 are pivoted to a minimum angle of inclination thereof, the spring 25 is completely contracted.

Within the rear housing 13, there are provided a central discharge chamber 26 and a suction chamber 27 arranged radically around the discharge chamber 26. The respective cylinder bores 10*a* form compression chambers defining in front of working heads of the respective pistons 26, and the compression chambers are fluidly connected to the discharge chamber 26 via respective discharge ports formed in the valve plate 12. The respective discharge ports of the valve plate 12 are opened and closed by discharge valves of which the opening movement is controlled by a retainer plate 26*a* provided in the discharge chamber 26.

Further, the compression chambers of the respective cylinder bores 10*a* are fluidly connected to the suction chamber 27 via respective suction ports formed in the valve plate 12, and the suction ports are opened and closed by suction valves arranged on an inner face of the valve plate 12 facing the rear end of the cylinder block 10.

A fluid withdrawing passage 28 is arranged to extend through the rear housing 13, the valve plate 12, and the cylinder block 10 so as to provide a fluid communication between the crank chamber 14 and the suction chamber 27. A fluid supply passage 29 functioning as a controlling passage is arranged to similarly extend through the rear housing 13, the valve plate 12, and the cylinder block 10 so as to provide a fluid communication between the crank chamber 14 and the discharge chamber 26, and a flow control valve 30 according to the present invention is arranged in a predetermined portion of the fluid supply passage, i.e., a predetermined position designated by the reference numeral "29*a*" (it will hereinafter be referred to as a valve opening) in the controlling passage 29 within the rear housing 13.

Figure 2:
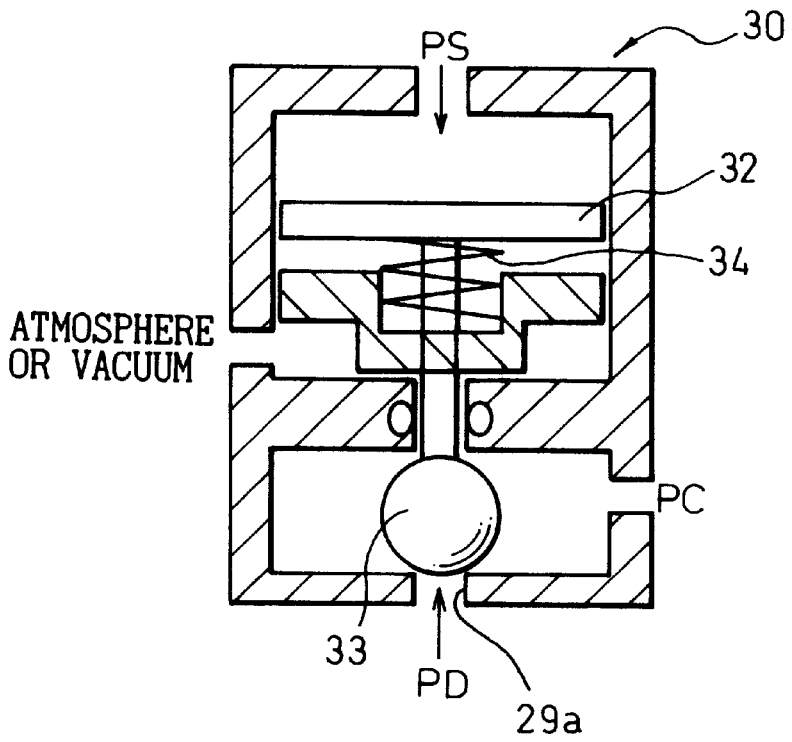
FIG. 2 is a schematic cross-sectional view of the flow control valve according to the first embodiment of the present invention, illustrating the arrangement and construction thereof.

Referring now to FIG. 2 in addition to FIG. 1, the flow control valve 30 of the first embodiment is provided with a pressure-sensing member 32 arranged to receive and to sense a suction pressure (Ps) when it is introduced into the valve 30 via a pressure-sensing passage 31 (FIG. 1). The pressure-sensing member 32 is provided to move in a valve housing in response to a change in the suction pressure (Ps).

The flow control valve 30 is further provided with a ball-like valve element 33 arranged to move in response to the movement of the pressure-sensing member 32 so as to adjustably change a valve opening formed in a fluid passage, i.e., in the above-mentioned predetermined portion of the controlling passage 29 extending between the crank chamber 145 and the discharge chamber 26. The ball-like valve element 33 is operatively connected to the pressure-sensing member 32 on which the suction pressure (Ps) acts so as to move the pressure-sensing member 32 in a direction reducing the valve opening in the controlling passage 29. The pressure-sensing member 32 also receives a spring force of a spring 34 which acts so as to urge the pressure-sensing member 32 in a direction increasing the valve opening of the controlling passage 29. The spring 34 is provided for applying a predetermined set force (F) to the pressure-sensing member 32. The valve element 33 constantly receives a discharge pressure (Pd) which acts so as to move the valve element 33 in a direction increasing the valve opening of the controlling passage 29.

It should be understood that the pressure-sensing member 32 might be formed by either a conventional diaphragm element or a conventional bellows member.

In the described flow control valve 30 of the first embodiment, when the suction pressure (Ps) acting on the pressure-sensing member 32 falls below a predetermined set pressure value, the pressure-sensing member 32 moves in a direction to move the valve element 33 away from the valve opening of the controlling passage 29. Namely, the valve opening is increased, and accordingly, the refrigerant under a discharge pressure (Pd) is supplied from the discharge chamber 26 into the crank chamber 14 via the controlling passage 29. Thus, a pressure (Pc) in the crank chamber 14 (it will be hereinafter referred to as a crank chamber pressure (Pc)) is increased so as to increase a back pressure acting on the respective pistons 16 to thereby reduce the angle of inclination of the cam plate 20 and the wobble plate 23 within the crank chamber 14. As a result, the reciprocating stroke of the respective pistons 16 is reduced to reduce the discharge amount of the refrigerant after compression. Therefore, the overall displacement of the compressor 1 is reduced.

It will be understood that since the discharge pressure (Pd) acts on the valve element 33 of the flow control valve 30 to move it in a direction to increase the valve opening in the controlling passage 29, when the discharge pressure (Pd) is increased, the valve element 33 is permitted to easily move in a direction to increase the valve opening in the controlling passage 29 due to the increase in the discharge pressure (Pd), and accordingly, the supply of the refrigerant under the high discharge pressure (Pd) from the discharge chamber 26 into the crank chamber 14 is accelerated to result in a quick reduction in the displacement of the compressor 1. The reduction in the displacement of the compressor 1 causes an increase in the suction pressure (Ps). Therefore, when the above-mentioned relationship between the suction pressure (Ps) and the discharge pressure (Pd) is taken into account, the following equation (1) is generally established with regard to the flow control valve 30.

$$Ps=F/As+(Ad/As)\ Pd \tag{1}$$

where Ps is a suction pressure acting on the pressure-sensing member 32 so as to reduce the valve opening in the controlling passage 29; Pd is a discharge pressure acting on the valve element 33 so as to increase the valve opening in the controlling passage 29; As is a surface area of the pressure-sensing member 32 to receive the suction pressure Ps; Ad is an area of the valve element 33 on which the discharge pressure Pd acts; and F is a set force acting on the valve element 33 via the pressure-sensing member 32.

Figure 3:
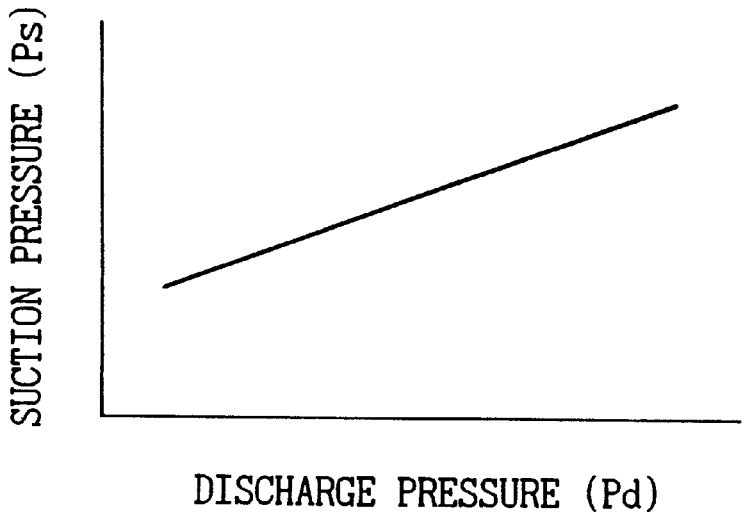
FIG. 3 is a diagrammatic view illustrating control characteristics exhibited by the compressor having the flow control valve of FIG. 2.

When the equation (1) above is shown in a coordinate system of FIG. 3 having an abscissa (X-axis) indicating the discharge pressure (Pd) and an ordinate (y-axis) indicating the suction pressure (Ps), it is shown by a straight line indicating a control characteristics of the flow control valve 30. The straight line can be expressed by the equation $y=ax+b$, $a>0$, which has a slope increasing from the left to the right in FIG. 3.

From the control characteristics shown by the above-mentioned straight line, it is understood that when the discharge pressure (Pd) acting on the valve element 33 is increased, the suction pressure (Ps) acting on the pressure-sensing member 32 is also increased.

The operation of the vehicle refrigerating system including the refrigerant compressor 1 having the above-mentioned flow control valve 30 will be described below.

When a drive power is transmitted from an external drive power source, i.e., a vehicle engine to the drive shaft 15 of the compressor 1 via the solenoid clutch, the rotor element 18 and the cam plate 20 are rotated at the same rotating speed as that of the drive shaft 15. When the cam plate 20 having a given angle of inclination rotates, the non-rotatable wobble plate 23 on the cam plate 20 performs only a wobbling motion by which the respective pistons 26 are reciprocated, via the rods 24, in the respective cylinder bores 10*a*. Therefore, the suction of the refrigerant from the suction chamber 27 into the respective compression chambers, the compression of the sucked refrigerant, and the discharge of the compressed refrigerant from the compression chambers into the discharge chamber 26 are performed. The compressed refrigerant under a high discharge pressure in the discharge chamber 26 is subsequently delivered therefrom into the fluid passage 6*a* so as to be supplied to the gas cooler 2.

The refrigerant under a high pressure and also under a high temperature is cooled down to have a temperature substantially equal to that of the atmospheric temperature, and is subsequently delivered from the gas cooler 2 to the expansion valve 3 via the fluid passage 6*b*. The refrigerant is then expanded there to reduce its pressure and to become a mist-like gas-liquid phase refrigerant under a low temperature and a low pressure. The expanding operation of the expansion valve is, of course, conducted on the basis of the temperature and pressure of the refrigerant sensed at the outlet of the gas cooler 2 as described before.

The mist-like refrigerant is subsequently delivered from the expansion valve 3, via the fluid passage 6*c*, to the evaporator 4 (the absorption-type heat exchanger) in which it is evaporated. During the evaporation of the refrigerant within the evaporator 4, the heat of the air passing by the evaporator 4 is absorbed and the air is cooled. The cooled air is supplied into the vehicle compartment to cool it. The refrigerant evaporated by the evaporator 4 is further delivered therefrom to the accumulator 5 via the fluid passage 6*d*. The accumulator 5 holds therein a liquid-phase portion of the refrigerant, and delivers a gaseous refrigerant toward the suction chamber 27 of the compressor 1 via the fluid passage 6*e* to be compressed again by the compressor 1.

During the operation of the vehicle refrigerating system, the compressor 1 is operated on the basis of the aforementioned control characteristics of the flow control valve 30. Namely, when an actual or current suction pressure (Ps) of the refrigerant entering the suction chamber 27 is reduced to a pressure below a set pressure of the suction pressure (Ps), which is determined on the basis of the discharge pressure (Pd) of the refrigerant acting on the flow control valve 30, the valve element 33 increases the valve opening in the controlling passage 29 permitting the refrigerant under the discharge pressure (Pd) to flow from the discharge chamber 26 into the crank chamber 14. Therefore, the crank chamber pressure (Pc) in the crank chamber 14 is increased so that the angle of inclination of the cam plate 20 and the wobble plate 23 is reduced. Accordingly, the displacement of the compressor 1 is reduced.

On the other hand, when the actual or current suction pressure (Ps) of the refrigerant is increased to a pressure above the set pressure of the suction pressure (Ps), which is determined on the basis of the discharge pressure (Pd) of the refrigerant acting on the flow control valve 30, the valve element 33 reduces the valve opening in the controlling passage 29. Thus, the displacement of the compressor 1 is eventually increased.

When the speed of rotation of the drive shaft 15 is increased due to an increase in the speed of rotation of the vehicle engine, the discharge pressure (Pd) of the refrigerant compressed by the compressor 1 is quickly increased and, even though the throttling motion of the throttling means 3 (expansion valve) is retarded to make the reduction of the suction pressure (Ps) be delayed, the refrigerating system incorporating therein the compressor 1 with the flow control valve 30 can operate so as to compensate for the above-mentioned delay in the reduction of the suction pressure (Ps). Namely, due to the specific control characteristics of the flow control valve 30 of the compressor 1, the vehicle refrigerating system of FIG. 1 is able to quickly reduce the actual (current) suction pressure (Ps) sucked into the suction pressure 27 of the compressor 1 to a lesser pressure below the set pressure of the suction pressure (Ps) of the flow control valve 30. Accordingly, the displacement of the compressor 1 is quickly reduced so as to adjust the refrigerating performance of the vehicle refrigerating system, and the excess refrigeration by the refrigerating system can be prevented even when the speed of rotation of the vehicle engine is increased.

(The Second Embodiment)

Figure 4:
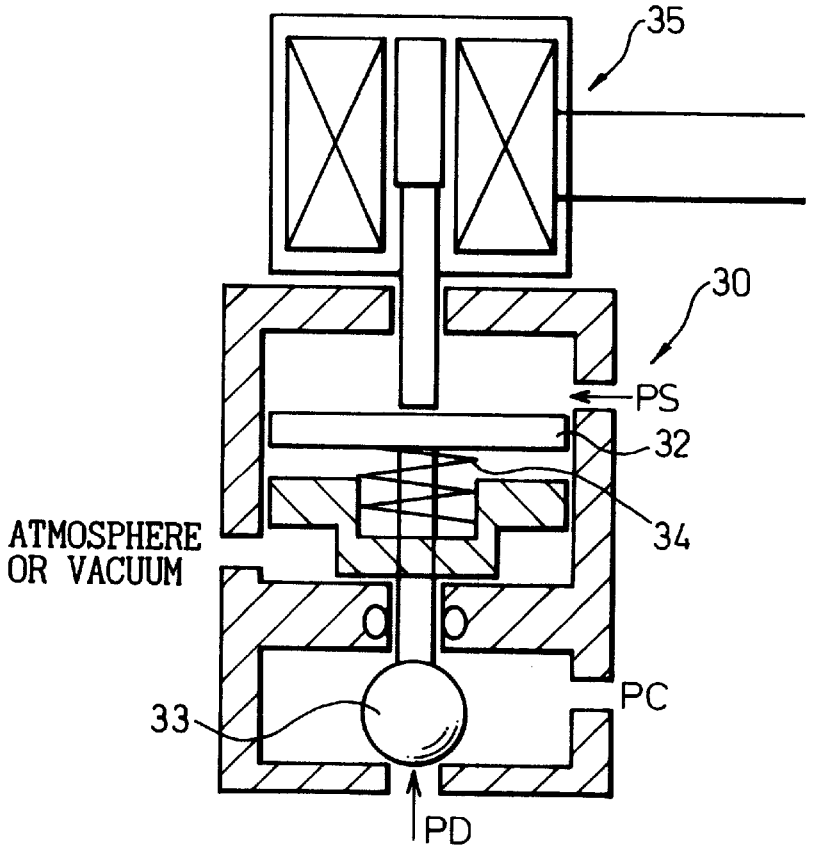
FIG. 4 is a schematic cross-sectional view of a flow control valve according to a second embodiment of the present invention, illustrating the arrangement and construction thereof.

FIG. 4 illustrates a flow control valve according to a second embodiment of the present invention, which is designated by the same reference numeral "30" as the first embodiment.

The flow control valve 30 of the second embodiment is different from that of the first embodiment in that the set pressure of the pressure-sensing member 32 may be adjustably varied by an externally-controlled solenoid 35 which is operative connected to an external control means (not shown in FIG. 4).

The set pressure value of the pressure-sensing member 32 of the flow control valve according to the second embodiment can basically vary to have a linear characteristic curve ascending from the left to the right, and operates in a similar way to the first embodiment so as to quickly reduce the displacement of the compressor 1 when an increase in the speed of rotation of a vehicle engine occurs. Further, as clearly shown in FIG. 5, the set pressure value of the pressure-sensing member 32 of the flow control valve 30 of this embodiment can be varied by the solenoid 35 to have a variation band between two linear curves "A" and "B" to adjustably change the temperature of the air blown by the evaporator 4. For example, when the set pressure value of the pressure-sensing member 32 of the flow control valve 30 is varied by the operation of the solenoid 35 along the higher linear characteristic curve "A" in the variation band of FIG. 5, even if the suction pressure (Ps) is reduced below the set pressure value of the flow control valve 30, the reduced suction pressure per se can be a relatively high pressure. Thus, the displacement of the compressor 1 is reduced when the pressure level of the suction pressure (Ps) is at a relatively high pressure level. Consequently, the temperature of the air blown by the evaporator 4 can be relatively high.

Figure 5:
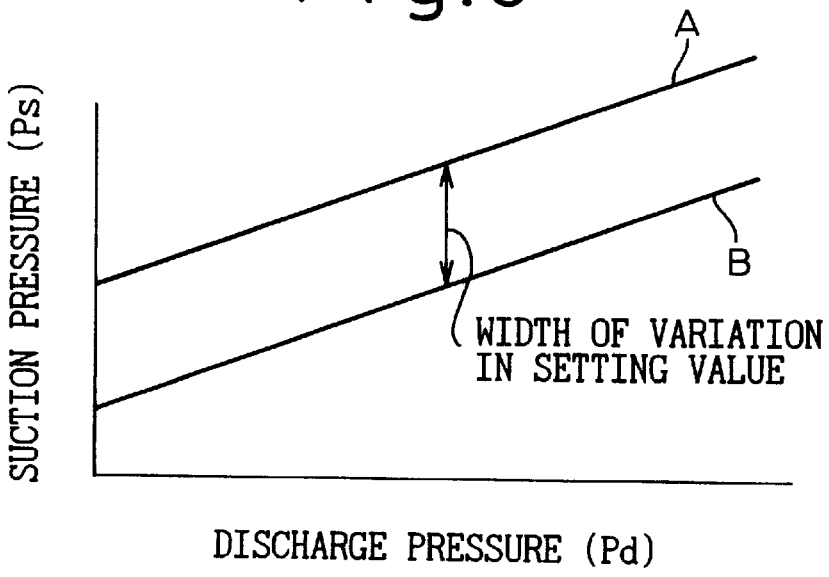
FIG. 5 is a diagrammatic view illustrating the operation to change a set pressure acting on a pressure sensing member of the flow control valve of the second embodiment.

On the hand, when the set pressure value of the pressure-sensing member 32 of the flow control valve 30 is varied by the operation of the solenoid 35 along the lower linear characteristic curve "B" in the variation band of FIG. 5, the suction pressure (Ps) is reduced below the set pressure value, when it is a relatively low pressure. Thus, the displacement of the compressor 1 cannot be reduced until the suction pressure (Ps) is reduced to the relatively low pressure. Accordingly, the temperature of the air blown by the evaporator 4 becomes low. Therefore, it can be understood that, by adjustably change the set pressure value of the pressure-sensing member 32 of the flow control valve 30 by the operation of the solenoid 35, a fine control of the air temperature in the vehicle compartment can be achieved. Namely, a fine climate control of the objective area (the vehicle compartment) can be achieved.

(The Third Embodiment)

Figure 6:
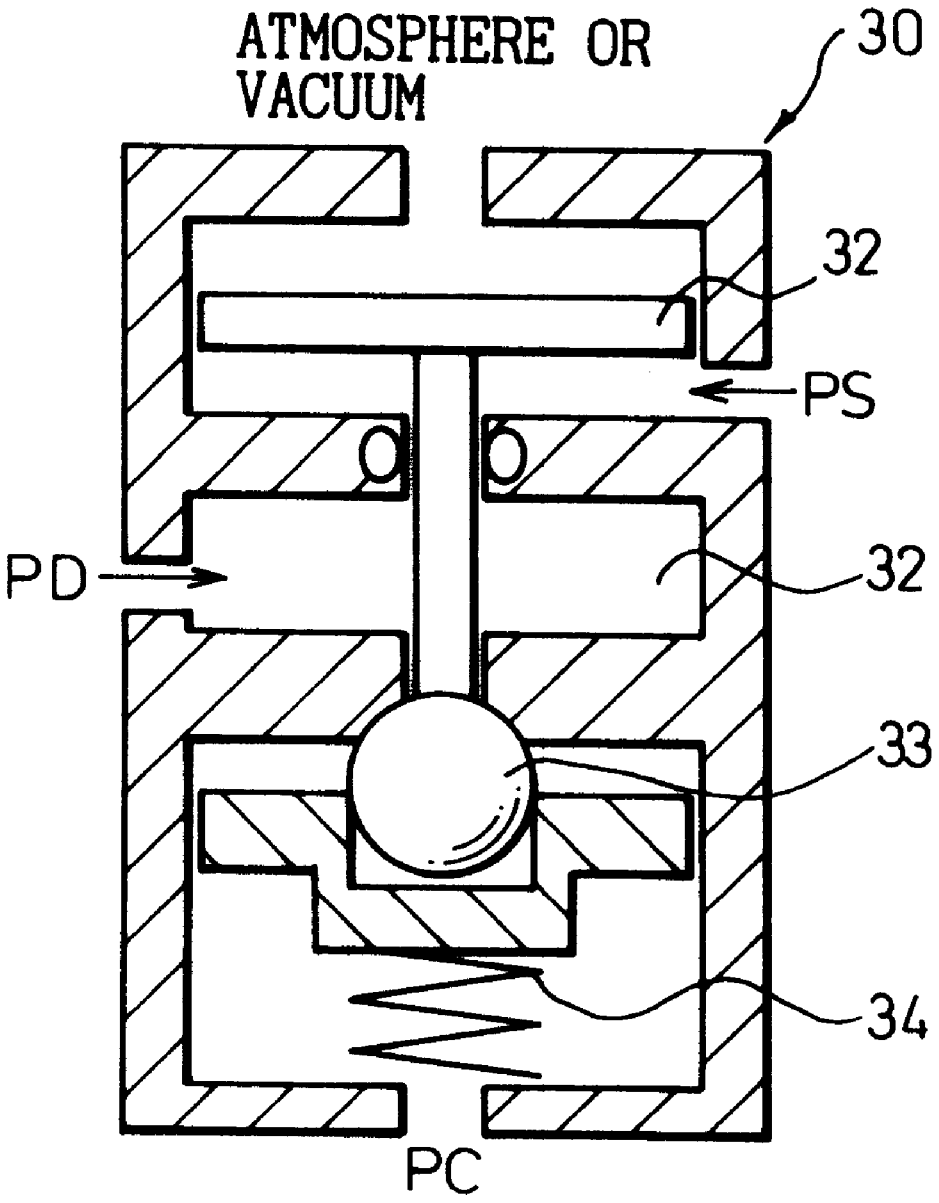
FIG. 6 is a schematic cross-sectional view of a flow control valve according to a third embodiment of the present invention, illustrating the arrangement and construction thereof.

FIG. 6 illustrates a flow control valve 30 according to a third embodiment of the present invention.

The flow control valve 30 of this embodiment is provided with a pressure-sensing member 32 which receives and senses the suction pressure (Ps) in a direction permitting the pressure-sensing member 32 to move together with a valve element 33 in a direction to close or reduce a valve opening arranged in the controlling passage 29. The pressure-sensing member 32 further receives a constant spring force of a spring 34 via the valve element 33 in a direction to close the valve opening in the controlling passage and to determined a set pressure value (F) of the suction pressure (Ps) acting on the pressure-sensing member 32. The valve element 33 receives the discharge pressure (Pd) in a direction to open or increase the valve opening of the controlling passage 29.

The flow control valve 30 of the third embodiment of the present invention can also have a control function according to the equation (1) described in connection with the flow control valve 30 of the first embodiment, and accordingly, can exhibit the control characteristics shown by the linear characteristic curve of FIG. 3.

(The Fourth Embodiment)

Figure 7:
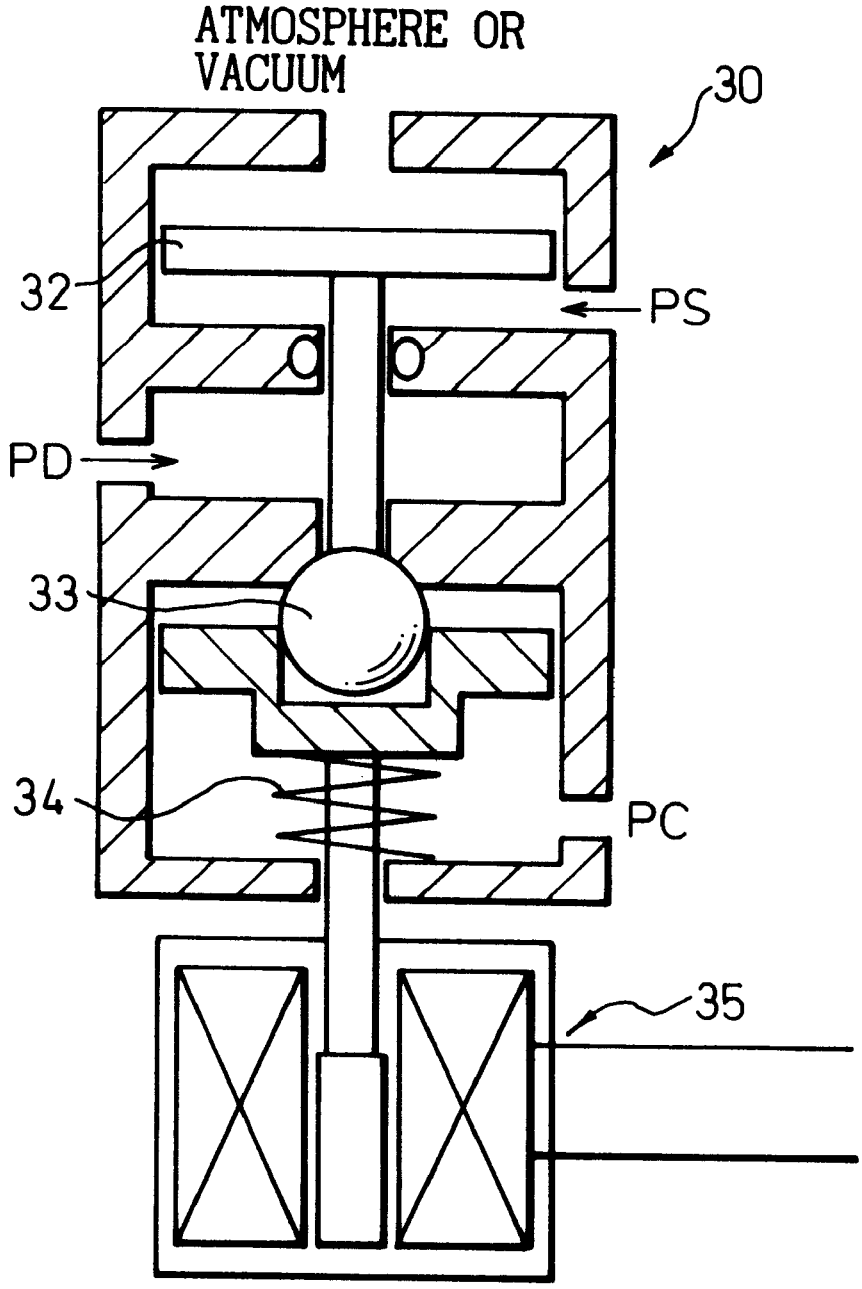
FIG. 7 is a schematic cross-sectional view of a flow control valve according to a fourth embodiment of the present invention, illustrating the arrangement and construction thereof.

A flow control valve 30 according to a fourth embodiment is illustrated in FIG. 7, which is different from the flow control valve 30 of the third embodiment in that the set pressure value of a pressure-sensing member 32 of the fourth embodiment can be adjustably varied by an electrically-controlled solenoid 35. Thus, the flow control valve 30 of the fourth embodiment can have the same control performance as that of the flow control valve 30 of the second embodiment.

(The Fifth Embodiment)

Figure 8:
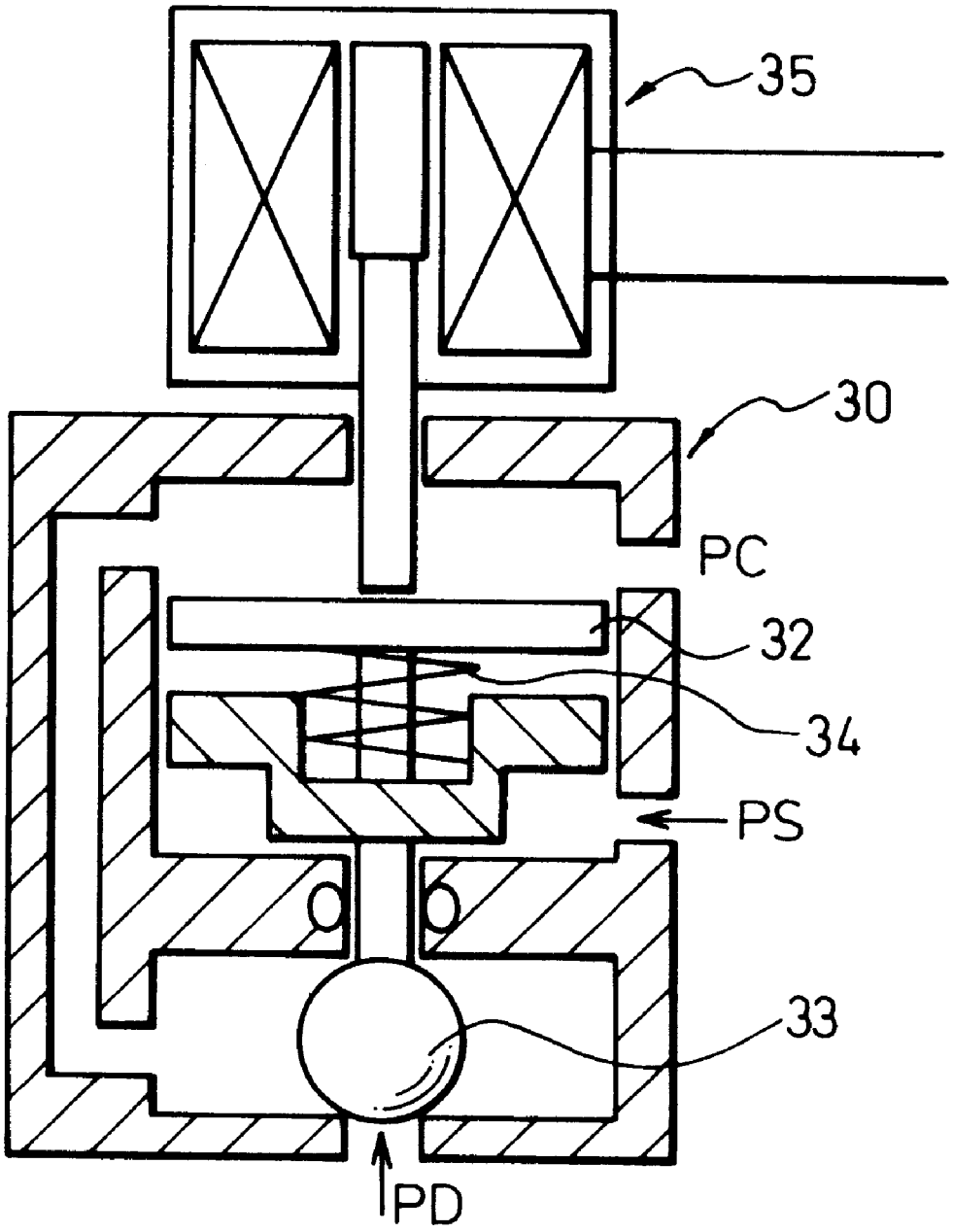
FIG. 8 is a schematic cross-sectional view of a flow control valve according to a fifth embodiment of the present invention, illustrating the arrangement and construction thereof.

FIG. 8 illustrates a flow control valve 30 according to a fifth embodiment of the present invention.

The flow control valve 30 of the fifth embodiment is provided with a pressure-sensing member 32 on which the suction pressure (Ps) acts so as to move a valve element 33 in a direction to open or increase a valve opening formed in the controlling passage 29, and also a spring force of a spring 34 acts so as to predetermine a set pressure value (F) acting on the pressure-sensing member 32. Further, the crank chamber pressure (Pc) acts on the pressure-sensing member 32 in a direction to close or reduce the valve opening in the controlling passage 29 due to the movement of the valve element 33. Further, the valve element 33 constantly receives the discharge pressure (Pd) in a direction to open or increase the valve opening in the controlling passage 29.

The flow control valve 30 of the fifth embodiment of FIG. 8 has a control performance substantially according to the equation (2) below.

$$Pc-Ps=F/As+(Ad/As)\ Pd \qquad (2)$$

where Ps is the suction pressure (Ps) acting on the pressure-sensing member 32 in a direction to increase the valve opening in the controlling passage 29; Pd is the discharge pressure acting on the valve element 33 in a direction increasing the valve opening in the controlling passage 29; Pc is the crank chamber pressure (Pc) acting on the pressure-sensing member 32 in a direction reducing the valve opening in the controlling passage 29; As is a surface area of the pressure-sensing member 32 on which the suction pressure and the crank chamber pressure act; Ad is an area of the valve element 33 on which the discharge pressure acts; and F is a set force value of the pressure-sensing member 33, acting on the valve element 33 (when F acts on the valve element 33 via the pressure-sensing member 32 to increase the valve opening, F is considered to be a positive value).

The flow control valve 30 of FIG. 8 having the control performance of the equation (2) exhibits a control characteristics expressed by a linear curve having a positive inclination ascending from the left to the right in a X-Y rectangular coordinate system in which X-axis indicates the discharge pressure (Pd), and Y-axis indicates a pressure differential ΔP (=Pc−Ps) between the suction pressure (Ps) and the crank chamber pressure (Pc).

Namely, when the discharge pressure (Pd) is increased, the above-mentioned pressure differential ΔP (=Pc−Ps) is also increased to result in an increase in the crank chamber pressure (Pc). When the crank chamber pressure (Pc) is increased, the displacement of the compressor 1 is reduced as described before. Therefore, when the above-mentioned pressure differential ΔP is increased in response to an increase in the discharge pressure (Pd) on the basis of the above-mentioned control characteristics, the displacement of the compressor 1 is quickly reduced to result in an increase in the suction pressure (Ps).

(The Sixth Embodiment)

Figure 9:
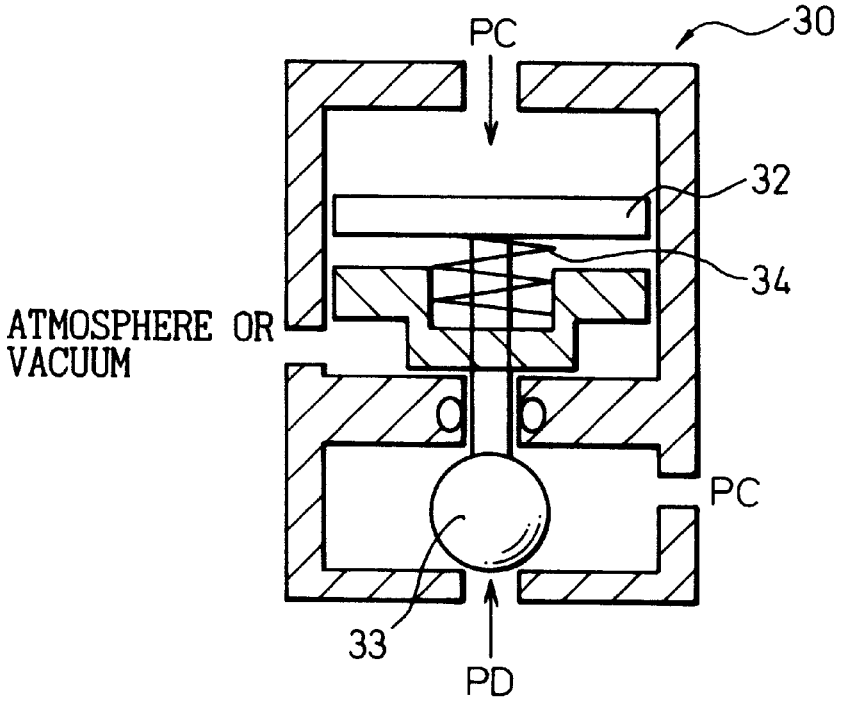
FIG. 9 is a schematic cross-sectional view of a flow control valve according to a sixth embodiment of the present invention, illustrating the arrangement and construction thereof.

FIG. 9 illustrates a flow control valve 30 according to the sixth embodiment of the present invention.

The flow control valve 30 of the sixth embodiment is provided with a pressure-sensing member 32 on which the crank chamber pressure (Pc) acts in a direction to close or reduce a valve opening in the controlling passage 29 via a valve element 33 connected to the pressure-sensing member 32, and a set pressure value applied to the pressure-sensing member 32 is determined by a spring force (F) of a spring 34 and acts in a direction to open or increase the valve opening in the controlling passage 29. Further, the valve element 33 receives the discharge pressure (Pd) acting in a direction opening or increasing the valve opening in the controlling passage 29.

The flow control valve 30 of the sixth embodiment basically acts so that the crank chamber pressure (Pc) is maintained at the set pressure value based on the force (F). Namely, when the crank chamber pressure (Pc) is equal to or above the set pressure value, the valve element 33 closes the valve opening in the controlling passage 29. Thus, as will be understood from FIG. 1, the refrigerant is withdrawn from the crank chamber 14 into the suction chamber 27 via the fluid withdrawing passage 28 of the compressor 1.

On the contrary, when the crank chamber pressure (Pc) is reduced below the set pressure value, the valve element 33 increases the valve opening in the controlling passage 29 to prevent a further reduction in the crank chamber pressure (Pc). Namely, the refrigerant under the high discharge pressure (Pd) is permitted to flow from the discharge chamber 26 into the crank chamber 14 of the compressor 1 via the valve opening in the controlling passage 29. As a result, the crank chamber pressure (Pc) is restored to the set pressure value based on the force (F). Thus, the crank chamber pressure (Pc) in the crank chamber 14 is substantially maintained at the set pressure value.

Figure 10:
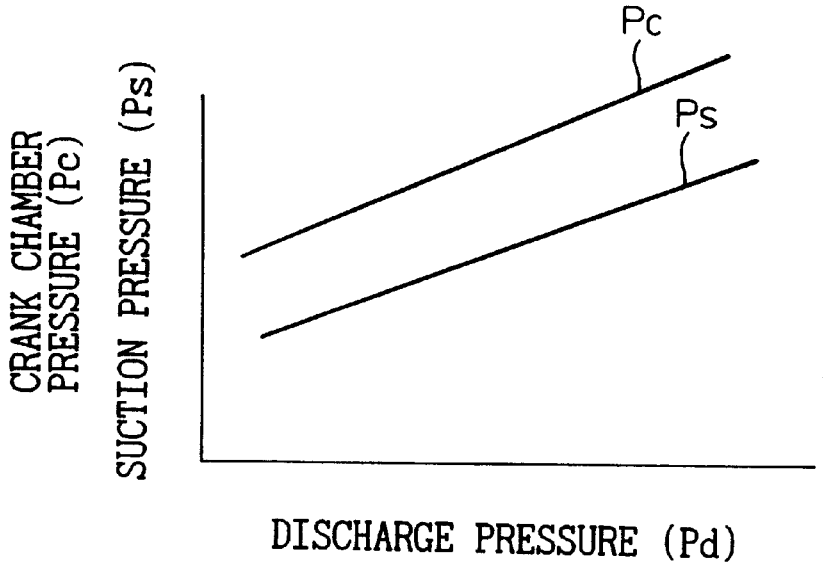
FIG. 10 is a diagrammatic view illustrating a relationship between a discharge pressure and either one of suction or crank chamber pressures.

In the flow control valve 30 of this embodiment, since the discharge pressure (Pd) acts on the valve element 33 so as to increase the valve opening in the controlling passage 29, the control characteristics of the flow control valve 30 of the sixth embodiment can be expressed by a linear characteristic curve ascending from the left to the right in a rectangular coordinate system as shown in FIG. 10. Namely, according to the linear characteristic curve of FIG. 10, the set pressure value of the crank chamber pressure (Pc) is increased in response to an increase in the discharge pressure (Pd). Therefore, the displacement of the compressor 1 can be varied on the basis of a relatively high crank chamber pressure (Pc) in the crank chamber 14.

Further, the crank chamber pressure (Pc) and the suction pressure (Ps) are maintained to have a predetermined relationship in which a constant pressure differential based on the throttling action of the fluid withdrawing passage 28 exists irrespective of a change in the discharge pressure (Pd) as shown by the two linear characteristic curves in FIG. 10. Therefore, when the crank chamber pressure (Pc) is increased, the suction pressure is correspondingly increased. Thus, the suction pressure (Ps) is increased in response to an increase in the discharge pressure (Pd).

The flow control valve 30 of the sixth embodiment has a control performance expressed by the equation (3) below.

$$Pc=F/Ac+(Ad/Ac)\ Pd \quad (3)$$

where Pc is the crank chamber pressure acting on the pressure-sensing member 32 in a direction reducing the valve opening in the controlling passage 29; Pd is the discharge pressure acting on the valve element 33 in a direction increasing the valve opening in the controlling passage 29; Ac is a surface area of the pressure-sensing member 32 on which the crank chamber pressure (Pc) acts; Ad is an area of the valve element 33 on which the discharge pressure (Pd) acts; and F is the set force value acting on the valve element 33 via the pressure-sensing member 32 (F is considered to have a positive value when it acts on the valve element 33 via the pressure-sensing member 32 so as to increase the valve opening in the controlling passage 29).

(The Seventh Embodiment)

Figure 11:
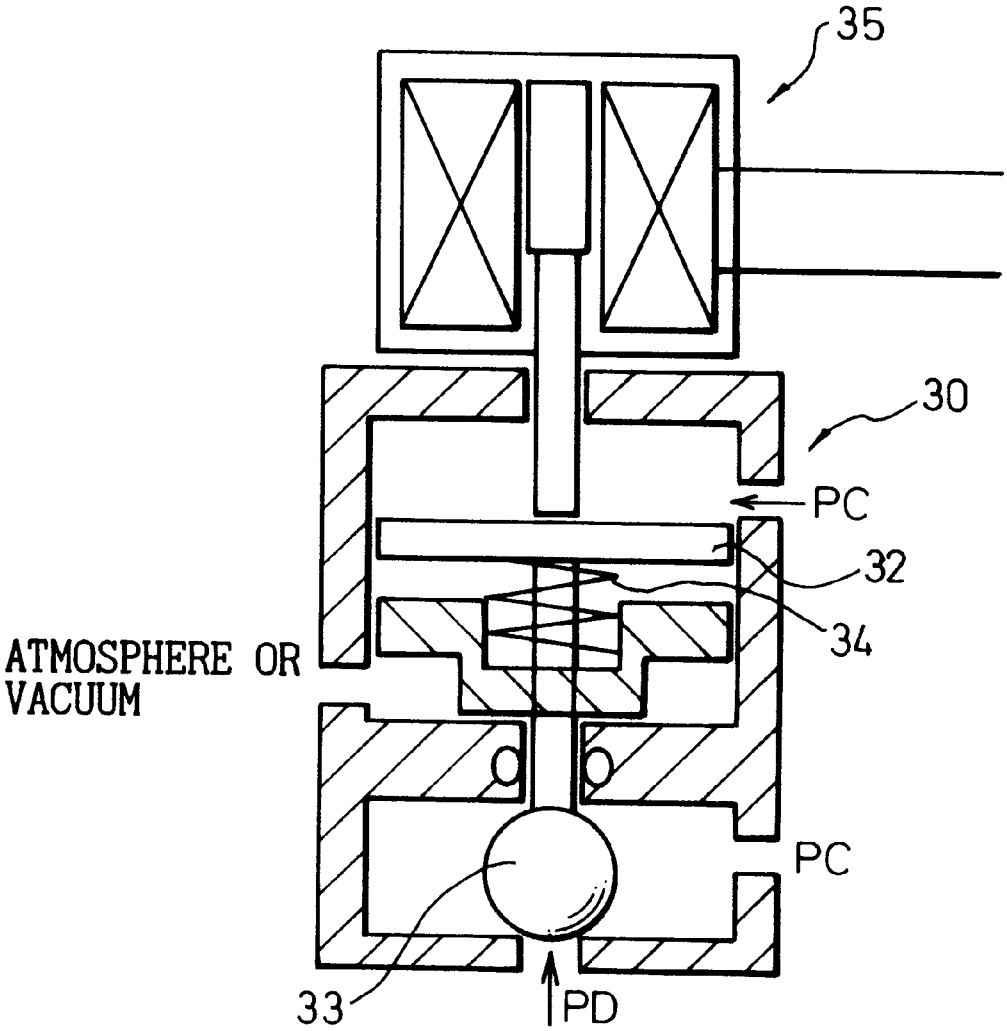
FIG. 11 is a schematic cross-sectional view of a flow control valve according to a seventh embodiment of the present invention, illustrating the arrangement and construction thereof.

FIG. 11 illustrates a flow control valve 30 according to the seventh embodiment.

The flow control valve 30 of this embodiment is different from the valve 30 of the previous sixth embodiment in that the set pressure value of a pressure-sensing member 32 of this embodiment can be varied by a solenoid 35 controlled externally. Therefore, due to adjustably varying the set pressure value (F) of the pressure-sensing member 32 by the operation of the solenoid 35, the flow of the refrigerant under a high pressure passing through the valve opening in the controlling passage 29 can be finely adjusted, and accordingly, a fine control of the climate control by the vehicle refrigerating system can be achieved.

(The Eighth Embodiment)

Figure 12:
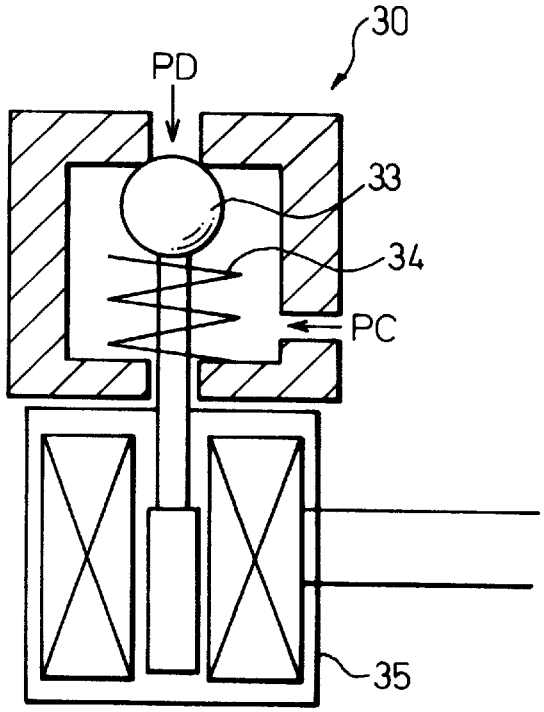
FIG. 12 is a schematic cross-sectional view of a flow control valve according to an eighth embodiment of the present invention, illustrating the arrangement and construction thereof.

FIG. 12 illustrates a flow control valve 30 according to the eighth embodiment.

The flow control valve 30 of this embodiment is constructed in such a manner that a pressure-sensing member formed by a pressure-sensitive elastic member such as a diaphragm and a bellows element is eliminated. Alternately, a valve element 33 is arranged to receive both of the discharge pressure (Pd) and the crank chamber pressure (Pc). At this stage, the pressures (Pd) and (Pc) act on the valve element from axially opposite directions. More specifically, the crank chamber pressure (Pc) acts on the valve element 33 in a direction reducing a valve opening, and the discharge pressure (Pd) acts on the valve element 33 in a direction increasing the valve opening in the controlling chamber 29. Further, a spring 34 is arranged so as to exhibit a spring force (F), which acts on the valve element 33 to thereby apply a predetermined set pressure value. However, the spring force (F) of the spring 34 can be adjustably varied by a solenoid 35 controlled externally.

It should be understood that the basic control performance of the flow control valve 30 of the eighth embodiment is substantially the same as that of the flow control valve 30 of the sixth or seventh embodiment.

(The Ninth Embodiment)

Figure 13:
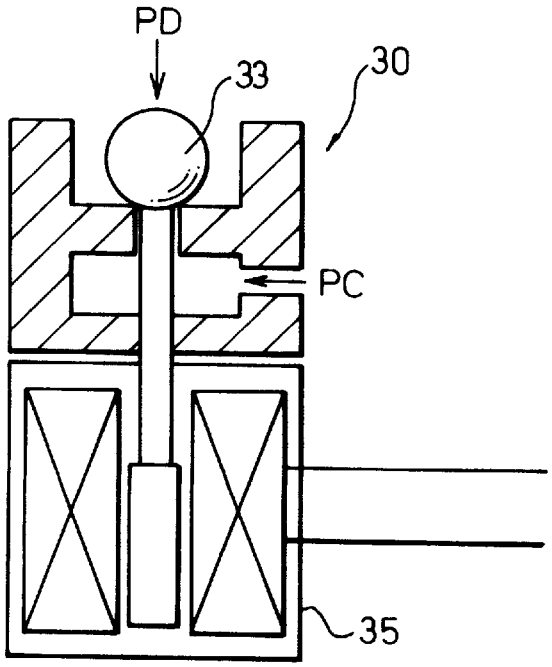
FIG. 13 is a schematic cross-sectional view of a flow control valve according to a ninth embodiment of the present invention, illustrating the arrangement and construction thereof.
Figure 14:
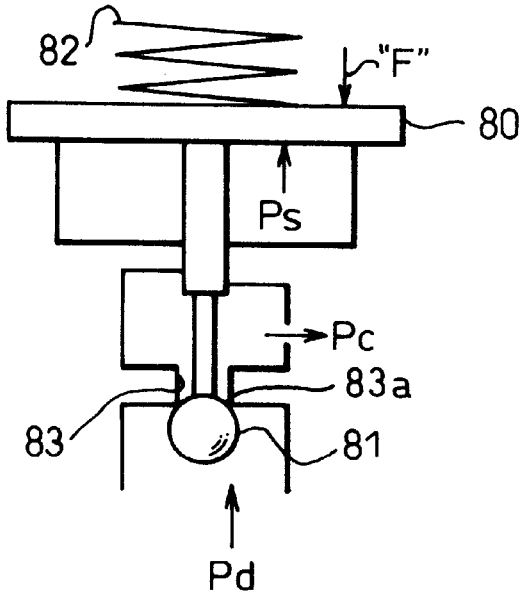
Fig.14 (PRIOR ART)
FIG. 14 is a schematic cross-sectional view of a flow control valve according to the prior art.
Figure 15:
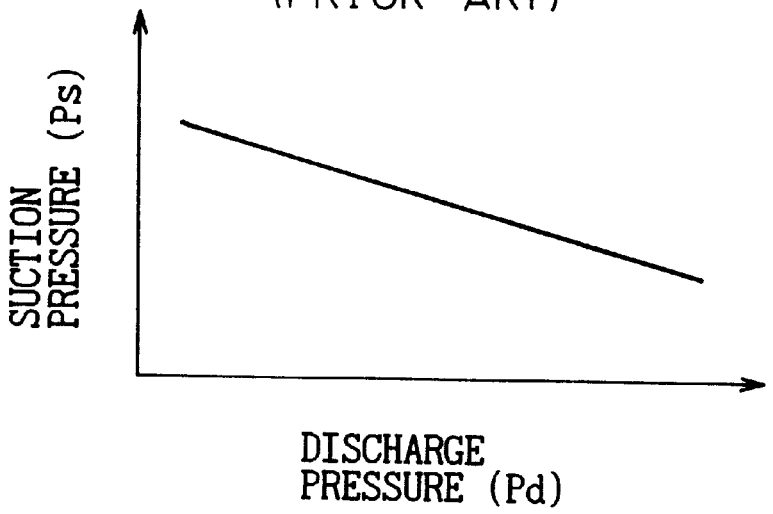
Fig.15 (PRIOR ART)
FIG. 15 is a diagrammatic view illustrating control characteristics exhibited by the flow control valve of FIG. 14.

FIG. 13 illustrates a flow control valve 30 according to the ninth embodiment.

The flow control valve 30 of this embodiment is constructed by eliminating a pressure-sensing member formed by a pressure-sensitive elastic element and a spring to apply a spring force determining a set pressure value. Namely, in the flow control valve 30 of this embodiment, a valve element 33 is arranged to adjustably increase or reduce a valve opening in the controlling passage 29 due to a controlled operation of a solenoid 35. More specifically, the discharge pressure (Pd) acts on the valve element 33 in a direction reducing the valve opening, and the solenoid 35 applies an electromagnetic force to the valve element 33 in a direction to increase the valve opening in the controlling passage 29.

When the solenoid 35 is controlled by an external control signal in such a manner that the electromagnetic force thereof is increased in response to an increase in the discharge pressure (Pd), the flow control valve 30 of this embodiment is able to have a control characteristics in which the crank chamber pressure (Pc) is increased in response to an increase in the discharge pressure (Pd). Accordingly, it is possible to increase the suction pressure (Ps) in response to an increase in the discharge pressure (Pd).

In the described various embodiments of the present invention, the flow control valve 30 is arranged in a predetermined valve opening (the position 29*a*) in the controlling passage 29 to adjustably control the flow of the refrigerant from the discharge chamber 26 into the crank chamber 14 by the valve element 33 when the refrigerant passes through the valve opening. Namely, the flow control valve 30 is used for controlling the supply of the refrigerant under a high discharge pressure from the discharge chamber 26 to the crank chamber 14 in order to regulate the pressure level of the crank chamber pressure (Pc).

Nevertheless, the use of the flow control valve 30 is not limited to the described embodiments, and the flow control valve 30 may alternately be used in a different manner in order to regulate the pressure level of the crank chamber pressure (Pc). For example, when the fluid withdrawing passage 28 arranged between the suction chamber 27 and the crank chamber 14 is used as a controlling passage, the flow control valve 30 may be arranged in a predetermined position in the fluid withdrawing passage 28 so as to regulate the flow of the refrigerant withdrawn from the crank chamber 14 into the suction chamber 27 to thereby adjustably change the pressure level of the crank chamber pressure (Pc). Then, the valve element 33 of the flow control valve 30 is arranged so that a valve opening formed in the predetermined position in the fluid withdrawing passage 28 is increased and reduced by the movement of the valve element 33 toward and away from the valve opening. In this case, the discharge pressure (Pd) is applied to the flow control valve 30 so that it acts on the valve element 33 in a direction reducing the valve opening in the controlling passage 28 (the fluid withdrawing passage 28). Thus, in response to an increase in the discharge pressure (Pd), the set pressure value of the pressure-sensing member 32 of the valve 30 is increased, and as a result, the crank chamber pressure (Pc) and the suction pressure (Ps) are increased.

In the described embodiments, the vehicle refrigerating system is constructed as a supercritical type refrigerating system employing the carbon dioxide ($CO_2$) as the refrigerant. However, the present invention is applicable to a subcritical-cycle-type refrigerating system employing the fluorinated hydrocarbon as the refrigerant. In the subcritical-cycle-type refrigerating system, if the flow control valve is provided with such a control characteristics that the suction pressure (Ps) increases in response to an increase in the discharge pressure (Pd), the displacement of the compressor in the refrigerating system can be quickly reduced in order to reduce the refrigerating performance of the system when the number of rotation of the drive shaft of the compressor is increased.

Although the foregoing description of the present invention is provided with reference to only the preferred embodiments thereof, many changes and modifications will occur to a person skilled in the art without departing from the scope and spirit of the present invention as claimed in the accompanying claims.

What we claim is:

1. A flow control valve for use with a variable displacement refrigerant compressor having a drive shaft rotationally driven by a drive source, a cylinder block provided with a cylinder bore allowing a piston to reciprocate therein to thereby compress a refrigerant sucked from a suction chamber and discharge the refrigerant after compression into a discharge chamber, a variable inclination cam plate arranged in a crank chamber to reciprocate the piston on the basis of the rotation of the drive shaft and to change a reciprocating stroke of the piston in response to an adjustable change in a crank chamber pressure prevailing in the crank chamber, and a controlling passage fluidly connecting the crank chamber to one of the discharge and suction chambers, wherein said flow control valve comprises:

a pressure sensing member arranged to perform a movement upon sensing at least one of a suction pressure and a crank chamber pressure;

a valve element operatively engaged with the pressure sensing member and to adjustably change an opening formed in a predetermined portion of said controlling passage in response to the movement of said pressure sensing member caused by the sensing of at least one of the suction and crank chamber pressures; and means for forming an arrangement wherein said pressure sensing member and said valve element have a flow controlling characteristics such that the suction pressure acting on said pressure sensing member increases in compliance with an increase in a discharge pressure prevailing in said discharge chamber.

2. A flow control valve according to claim 1, wherein said valve element is arranged in said controlling passage fluidly interconnecting between said crank chamber and said discharge chamber of said variable displacement refrigerant compressor in a manner such that the discharge pressure acts on said valve element to urge the movement thereof in a direction increasing the opening of said predetermined portion of said controlling passage.

3. A flow control valve according to claim 2, wherein said valve element is provided with a spherical surface area confronting said opening of said predetermined portion of said controlling passage and receiving said discharge pressure.

4. A flow control valve according to claim 1, wherein said pressure sensing member is arranged to move upon sensing a change in one of the suction and crank chamber pressures with respect to a set pressure, and wherein said set pressure is changed by an electrically controlled solenoid.

5. A flow control valve according to claim 4, further comprising a spring element provided for applying a spring force suitable for determining said set pressure of said pressure sensing member.

6. A flow control valve according to claim 1, wherein said variable displacement compressor incorporating therein said flow control valve to control the displacement thereof is a compressor of the type wherein the delivery of the refrigerant after compression is conducted under a supercritical pressure of the refrigerant.

7. A flow control valve according to claim 5, wherein the refrigerant compressed by said variable displacement compressor is a carbon dioxide.

8. A variable displacement refrigerant compressor comprising:

a drive shaft rotationally driven by a drive source;

a cylinder block provided with a cylinder bore allowing a piston to reciprocate therein to thereby compress a refrigerant sucked from a suction chamber and discharge the refrigerant after compression into a discharge chamber;

a variable inclination cam plate arranged in a crank chamber to reciprocate said piston on the basis of the rotation of said drive shaft and to change a reciprocating stroke of said piston in response to an adjustable change in a crank-chamber pressure prevailing in said crank chamber;

a controlling passage fluidly connecting said crank chamber to one of said discharge and suction chambers; and a flow control valve arranged in said controlling passage to regulate a flow of the refrigerant which passes through a predetermined portion of said controlling passage, wherein said flow control valve comprises:

a pressure sensing member arranged to perform a movement in response to sensing of at least one of the suction pressure and the crank-chamber pressure;

a valve element operatively engaged with said pressure sensing member and to adjustably change an opening formed in said predetermined portion of said controlling passage in response to the movement of said pressure sensing member caused by sensing of at least one of the suction and crank-chamber pressures; and means for forming an arrangement in which said pressure sensing member and said valve element have a flow controlling characteristics such that the suction pressure acting on said pressure sensing member increases in compliance with an increase in the discharge pressure prevailing in said discharge chamber.

9. A variable displacement refrigerant compressor according to claim 8, wherein the refrigerant after compression is delivered from said discharge chamber as the refrigerant under supercritical pressure.

10. A variable displacement refrigerant compressor according to claim 8, wherein the refrigerant is carbon dioxide.

* * * * *

UNITED STATES PATENT AND TRADEMARK OFFICE

CERTIFICATE OF CORRECTION

PATENT NO. : 6,260,369 B1
DATED : July 17, 2001
INVENTOR(S) : Yokomachi et al.

It is certified that error appears in the above-identified patent and that said Letters Patent is hereby corrected as shown below:

Column 4,
Lines 38, 39 and 55, delete "C." and insert therefor -- C --.

Signed and Sealed this

Twenty-third Day of April, 2002

*Attest:*

*Attesting Officer*

JAMES E. ROGAN
*Director of the United States Patent and Trademark Office*